US005086797A

United States Patent [19]

Earnshaw et al.

[11] Patent Number: 5,086,797

[45] Date of Patent: Feb. 11, 1992

[54] UMBRELLA FRAME

[75] Inventors: John M. Earnshaw, Crowedge; Michael H. Bly, New Mill, both of United Kingdom

[73] Assignee: Holyand Fox Limited, England

[21] Appl. No.: 431,830

[22] Filed: Nov. 6, 1989

[30] Foreign Application Priority Data

Nov. 9, 1988 [GB] United Kingdom ..... 8826209
Jan. 18, 1989 [GB] United Kingdom ..... 8901086

[51] Int. Cl.[5] ..... A45B 11/00
[52] U.S. Cl. ..... 135/20.1
[58] Field of Search ..... 135/20 A, 20.3

[56] References Cited

U.S. PATENT DOCUMENTS

| | | | |
|---|---|---|---|
| 835,306 | 11/1906 | Mangelsdorf | 135/20 A |
| 1,996,071 | 4/1935 | Kahn . | |
| 2,496,769 | 2/1950 | Battle | 135/22 |
| 2,605,778 | 8/1952 | Clapper . | |
| 2,671,459 | 3/1954 | Henderson | 135/20 A |
| 2,724,396 | 11/1955 | Pereira | 135/20 A |
| 2,906,278 | 9/1959 | Small | 135/20 A |

FOREIGN PATENT DOCUMENTS

| | | | |
|---|---|---|---|
| 61414 | 9/1913 | Fed. Rep. of Germany . | |
| 750914 | 6/1933 | France . | |
| 1456197 | 9/1966 | France . | |
| 511140 | 1/1955 | Italy | 135/20 A |

*Primary Examiner*—Richard E. Chilcot, Jr.
*Assistant Examiner*—Lan Mai
*Attorney, Agent, or Firm*—Antonelli, Terry, Stout & Kraus

[57] ABSTRACT

A frame for an umbrella has a shaft (4,5), ribs (7) extending radially from the top of the shaft, and stretchers (6) extending from a runner (2) on the shaft to attachment points on the ribs. The shaft comprises first and second parts (4,5) connected by a pivot or bending portion, e.g. a joint (1), located at a position between the top of the shaft and the runner (2) to allow the axis of the upper part of the shaft to be set in a position inclined to the axis of the part of the shaft below the pivot. This provides a stable tilting arrangement. Advantageously, the joint (1) can be a snap-in ball joint which is easy to assemble and manipulate.

10 Claims, 5 Drawing Sheets

UMBRELLA FRAME

FIELD OF THE INVENTION

The invention concerns an umbrella frame having a shaft, which can be tilted so that, in use, the umbrella cover will be at an inclination to the shaft. Such a construction finds wide use, e.g. for garden or fishing umbrellas.

DESCRIPTION OF THE PRIOR ART

One known kind of tilting umbrella has a shaft at whose upper end is a so-called notch on which are pivoted ribs which support the cover. The ribs themselves are held up, in the erected position of the umbrella, by a corresponding number of stretchers attached pivotally at one end to the ribs and at the other, again pivotally, to a runner which can slide along the shaft in order to fold and unfold the umbrella. In the upper position of the runner, with the umbrella unfolded, the runner is held in place by a catch. In order to provide the required tilting facility for the umbrella, a joint is provided in the shaft at a point below the upper position of the runner.

While this arrangement does allow the head of the umbrella to tilt with respect to the shaft, it has a number of disadvantages, most notably that, during folding and unfolding of the umbrella, the runner tends to catch on the joint. The presence of a tilting joint in the shaft also allows play in the umbrella, and the fact that the entire head of the umbrella, from the tilting joint upwards, is inclined when the tilt facility is used means that the centre of gravity of the umbrella is displaced some way off the shaft axis, leading to instability and difficulties in handling especially in windy conditions. Further, the joint itself must fit within the confines of the shaft diameter, since the runner has to pass over it to fold and unfold the umbrella. This limits both the strength and the configuration of the joint.

To overcome some of these difficulties, it has been proposed in British patent specifications 1 352 689 and 1 353 895 to use a supporting pole (shaft) which is formed in two sections, one of which carries the umbrella head (notch, ribs, stretchers and runner) and is adapted to have the second section connected to it in alternative ways. In the one case the pole can be used as a conventional straight pole or, for use as a wind-break, with the second(lower) section attached to a joint on the first section just below the notch inside the cover and inclined to the first section. The second case is similar except that for the windbreak, i.e. the tilted mode, the second pole section is connected outside the cover to a portion of the first section which is arranged to project beyond the top of the notch.

In both cases, releasable joint components have to be provided on the pole sections, and erection to the tilted position is somewhat cumbersome, and particularly with the external, is not at all easy even in a light wind.

SUMMARY OF THE INVENTION

According to the invention there is provided a frame for an umbrella, having a shaft, ribs extending radially from the top of the shaft, and stretchers extending from a location body on the shaft to attachment points on the ribs, means being provided for locating the location body at a set position on the shaft for holding an umbrella cover open, wherein the shaft comprises first and second parts connected by a tilting means to allow the axis of the one part of the shaft to be set in a position inclined to the axis of the other part of the shaft, characterised in that the tilting means is located at a position between the top of the shaft and the set position of the location body.

In practice, the invention is applicable to a folding umbrella in which the location body is a runner movable down the shaft from the set position, where it is held in place by a catch in the shaft, thus allowing the umbrella to fold. The ribs are pivotably connected to the notch, and the stretchers are pivotably connected to the runner. In theory, however, the invention could be used for a permanent or semi-permanent umbrella-type canopy where the location body for the stretchers is not necessarily slidable up and down the pole.

Surprisingly, the head of an umbrella according to the invention can be tilted about the tilting means without difficulty or damage to the frame, the slight alteration of the shape of the cover and the angle of the stretchers being accommodated by the inherent flexibility of the cover and pivotal connection or flexibility of the stretchers.

The invention allows a variety of tilting means to be used, since they are not restricted by having to allow passage of the runner: a flexible or bending portion of the shaft, or swivel, ball, hinged or universal joints may all be used. The joint may also include a locking arrangement which again is not limited by the diameter of the shaft. The head when tilted is close to the shaft, this being a more stable configuration than the conventional tilting construction, and provides more unobstructed space under the cover.

Advantageously the pivoting arrangement is such that the shaft comprises first and second parts connected by a ball-and-socket joint, the ball being attached to the first part of the shaft by a neck and the socket being attached to the second part, in which the socket is in the form of a cup, open in a direction away from the second part, with means for retaining the ball within the socket, and in which one of the members, either the ball or the socket, has a lug which projects from its spherical surface and the other member, the socket or the ball, as the case may be, has a first recess large enough to accommodate the lug, the lug and first recess being so arranged that when interengaged the two shaft parts are axially aligned, the first recess being surrounded by a further, annular, recess or a number of further recesses able to accommodate the lug so as to hold the two parts in a relative position such that the axis of the first part is at a given angle with respect to the second part of the shaft while allowing the first part to adopt different angular positions around the axis of the second part, the ball and/or socket being adapted so as to allow the ball to be rotated within the socket to move the lug from one recess to another and so as to retain the parts in a set position with the lug engaged in a recess.

Preferably, the lug is provided, for example integrally, on the ball and the recesses are provided in the socket. In a symmetrical arrangement, the lug and first recess will lie on the shaft axis of the first and second part respectively, although it is conceivable that for rotationally non-symmetrical arrangements the lug and first recess could be offset from the axis.

Conceivably the socket could be provided in two parts or with separate means to retain the ball in place, but in a preferred construction the socket is dimensioned at its mouth so as to be capable of resiliently receiving the ball by a snap-in action such that the joint can be readily assembled, and the ball is retained for normal use but could be removed if need be.

Intermediate further recesses, or an intermediate further annular recess, may be provided to afford one or more set angular positions at a lesser tilt angle if required.

In this embodiment the shaft has a reliable, robust joint which is easy to manipulate, clicks satisfyingly into position in the axially aligned position and at the set angle or angles of tilt, is easy to manufacture and assemble, and does not require tight tolerances. The particular design of ball and socket, with the lug on the ball, means that, once assembled, the joint is virtually impossible to dislocate inadvertently, vulnerability to dislocation being a common failing in ball joints. Thus, even if the first part with the ball is under strain to adopt a greater angle of tilt, the effect of the lug is to retain the ball within the socket.

Advantageously the two parts of the joint may be made of plastic materials, in particular nylon for the ball and acetal for the cup, the latter having a suitable combination of rigidity and resilience so that the joint can be assembled without undue difficulty but the ball will then remain captive in the cup.

Such a joint is particularly advantageous because in this case the constraints on the design of the joint are far less stringent as at no time does the runner have to pass over the joint which can therefore be locally of larger diameter than the shaft.

DETAILED DESCRIPTION OF THE PREFERRED EMBODIMENTS

Figure 1:
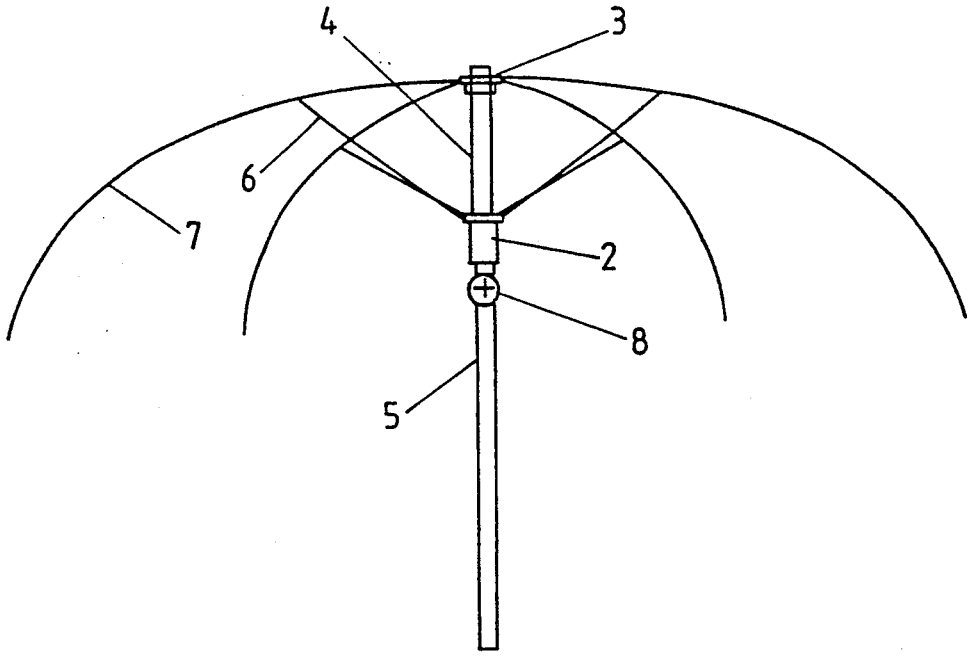
FIG. 1 PRIOR ART
FIG. 1 shows a conventional tilting umbrella.

FIG. 1 shows a known kind of tilting umbrella which has a shaft 5 having an upper, tiltable, part 4, ribs 7 and a corresponding number of struts or stretchers 6 extending from a sliding runner 2 located on the shaft to the ribs. In the complete umbrella, the ribs would, be covered by a cover, which is not shown, the shape of the cover and the connection of the stretchers causing the curvature of the ribs as seen in the drawing, the ribs being normally straight when unstressed. The ribs are pivoted at the top of the shaft on a notch 3, and the stretchers are pivotally connected both to the ribs and to the runner.

In the prior art tilting umbrella the upper part 4 of the shaft 5 pivots on the lower part by means of a joint 8 which, in the unfolded configuration of the umbrella, is situated a short way below the runner 2. A typical pivot joint will allow a tilt of about 45° in one direction. In order to fold up the umbrella the upper shaft 4 has to be in the upright (untilted) condition, and then the runner is released from a catch and slid down the shaft 5, passing over the straightened joint 8. The diameter of the entire joint 8 when not tilted must, not exceed that of the shaft. In addition the joint 8 is relatively far from the top of the shaft, so that, when the head of the umbrella is tilted, the centre of gravity of the whole is displaced considerably from the axis of the shaft making the umbrella unstable about the base of the shaft and liable to rotate about the axis of the shaft.

Figure 2:
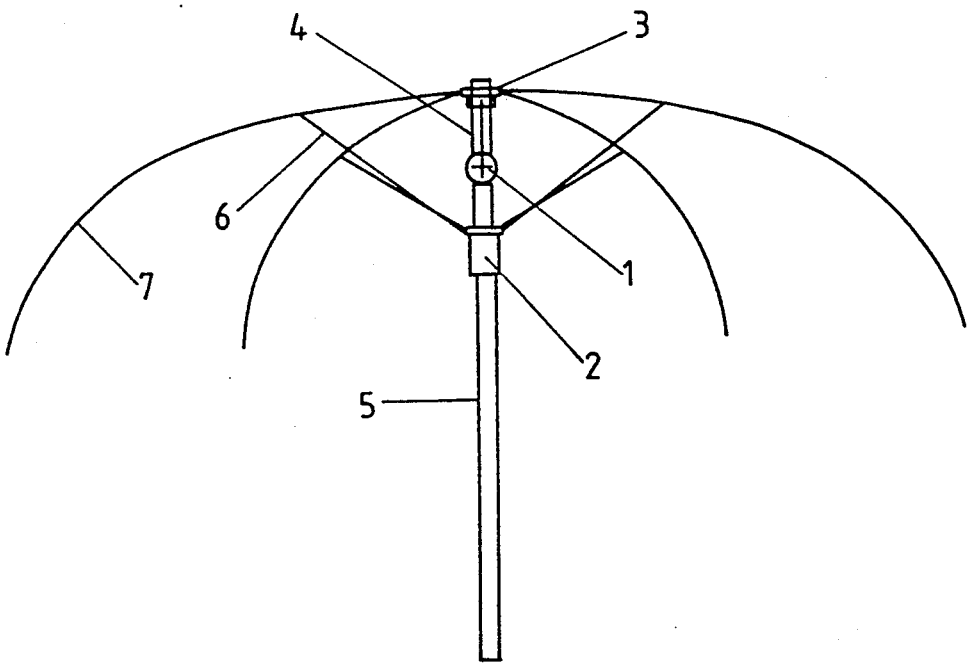
FIG. 2 shows a first embodiment of the invention in the upright position.
Figure 3:
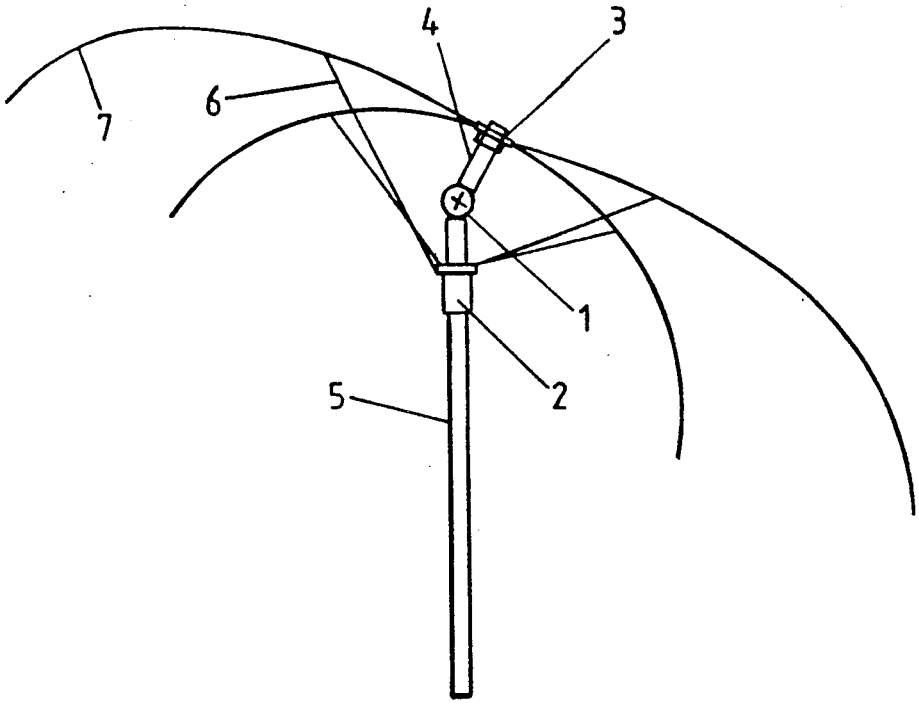
FIG. 3 shows the embodiment of FIG. 2 with the head tilted.

FIGS. 2 and 3 show a first embodiment of the invention, which is similar to the prior art umbrella shown in FIG. 1 except that a joint 1 is located in the shaft between the runner 2, which forms the location body for the stretchers, and the notch 3, rather than below the runner 2. It has been found that a joint 1 in this location, even though it is above the stretcher anchorages, allows the head to be tilted, the slight alteration of the rotationally symmetrical shape of the ribs and cover being taken up by the flexibility of the cover and permitted by the pivotal attachment of the stretchers.

Figure 9:
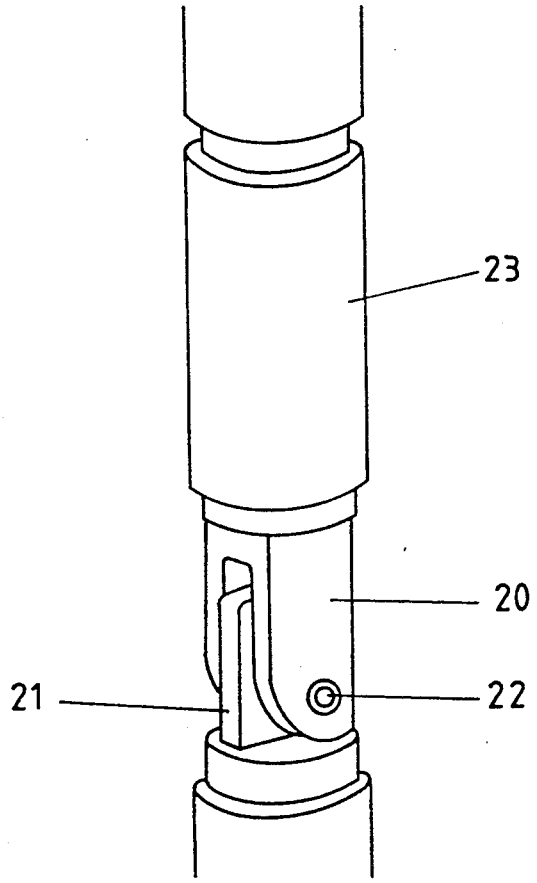
FIG. 9 PRIOR ART
FIG. 9 shows a known type of joint for an umbrella shaft.

For the joint 1, a flush joint, i.e. one which lies within the shaft cross-section when straight, can be used, such as that used in the FIG. 1 embodiment, allowing approximately 45° rotation in a single direction. Such a known joint is shown schematically in FIG. 9 and can be seen to consist of a parallelplate arrangement 20 on one part of the shaft and sandwiching a single plate 21 on the other part. The two can pivot relative to each other in their plane on a pin 22. A sliding sleeve 23 can be lifted to allow pivoting or lowered to maintain the straight configuration of the shaft.

This embodiment brings several advantages, as follows: the tilted head is near the shaft, allowing more space underneath the umbrella unobstructed by the shaft, yet keeping the centre of gravity of the umbrella near the shaft axis; the runner does not travel over the joint during folding and unfolding; and there is virtually no play in the assembly, since the single joint is held taut by the tension in the cover.

However, further advantages may be obtained from the construction according to the invention, because other kinds of joint can be used for the joint 1, since it is not constrained by the necessity of allowing the runner to pass over it. Thus, a more robust, thicker joint of the same type as before can be used, or in a further variation, a universal joint, such as a ball-and-cone joint, can be used. This kind of joint allows the user to change both the direction and the angle of tilt without altering the angular position of the shaft of the umbrella. This has the advantage that if the cover is asymmetrical, e.g. has an oval or rectangular shape, the umbrella can be adjusted on site so that the edge or edge of the cover is lowermost, as usually required. If the shaft merely has a standard pivoting joint (pivotable in one plane) the cover must be aligned during manufacture with the tilt plane of the joint, a painstaking operation.

The fact that the size of the joint is not restricted by the diameter of the shaft means that it can be provided with a locking mechanism which again can be wider than the shaft. Thus a mechanism can be used which can lock the upper part of the shaft at any angle, not merely in the straight condition, as previously when using a locking sleeve.

Because the previous restrictions on the pivot joint are avoided, there are wider possibilities for design of the pivot joint especially in the choice of materials which may be used.

A joint particularly suitable for use in an umbrella frame in accordance with the invention is shown in FIG. 4.

Here the two parts of an embodiment of a joint 1 are shown in the course of being assembled. The ball 10 is attached via a neck 13 to a first part 4 of a shaft, and the cup 11 is fixed on to the other part 5 of the shaft by any suitable method, such as crimping or adhesive fixing.

The ball 10 and cup 11 are made of semi-rigid material such as nylon and acetal respectively so that they can be readily assembled by simply pressing the ball 10 into the socket formed within the cup 11 with a snap-in action. This is achieved by means of an inwardly formed lip 9 around the mouth of the cup of slightly smaller diameter than that of the ball 10. This lip 9 then serves to retain the ball in place.

The ball 10 has, opposite the neck 13, a lug or snout 12 of generally conical shape tapering away from the centre of the ball. The cup 11 has a socket with an internal spherical contour roughly corresponding to that of the ball 10 except for a recess 14 corresponding to the snout 12 and a further, annular, recess 15 coaxial with the shaft and subtending an angle of about 45° at the centre of the socket.

Figures 4A, 4B, 4C:
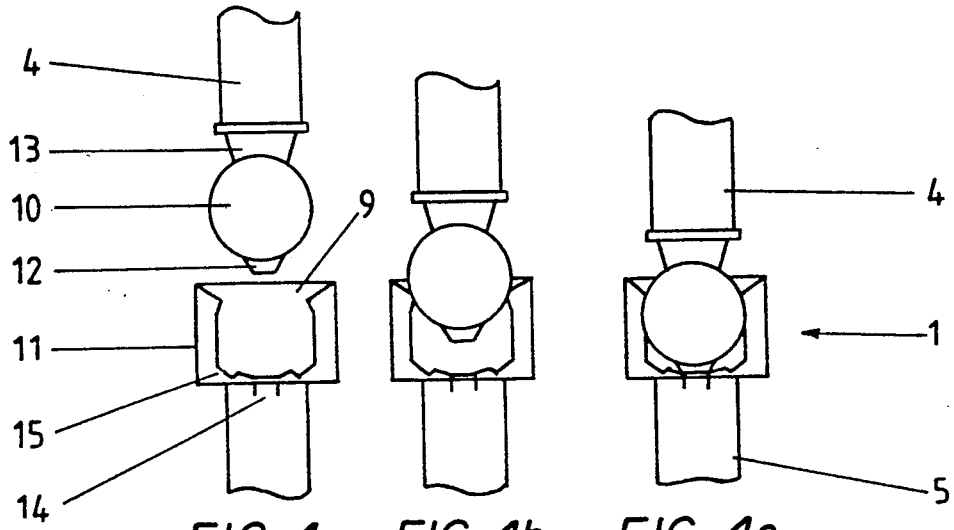
FIGS. 4*a*, 4*b*, and 4*c* show diagrammatically the two parts of a joint in accordance with a further embodiment of the invention being assembled.
Figures 5A, 5B:
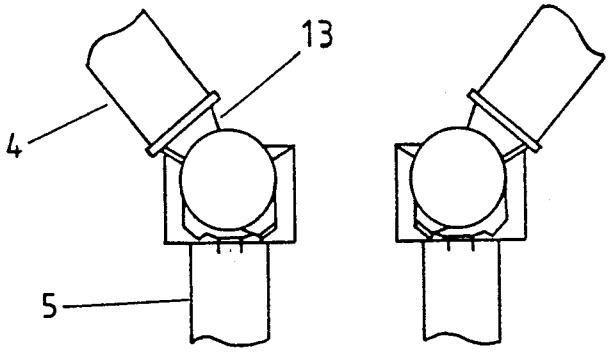
FIGS. 5*a* and 5*b* show the joint of FIG. 4, tilted.

Both the recess 14 and the annular recess 15 are adapted to receive the snout 12 of the ball 10 when the ball is fully inserted into the cup and at the appropriate angular orientation. FIG. 4*c* shows the joint in the assembled condition with the two parts of the shaft axially aligned. When a moderate pressure is applied to bend the shaft about the joint, the snout 12 slips easily out of the recess 14 and holds the joint at any desired angle owing to the resilience of the material of the cup 11 (and of the ball). When the joint is bent to its maximum angle, as shown in FIGS. 5*a* and 5*b*, the snout 12 snaps into the annular recess 15, giving a firm location to the bent shaft. With this embodiment, the upper part 4 of the shaft can of course, be rotated to any desired angular position about the axis of the lower part of the shaft 5, the snout 12 simply moving around the annular recess 15. However, in other embodiments, instead of an annular recess, a number of individual recesses arranged in a circle around the recess 14 could be provided.

It is virtually impossible to dislocate the ball 10 from the cup 11 by excessive bending pressure, since the snout 12 engages in the annular groove 15 and would merely abut more firmly against the flank of the recess, and the neck 13 would press on the rim of the cup. The joint is thus very stable.

Figure 6:
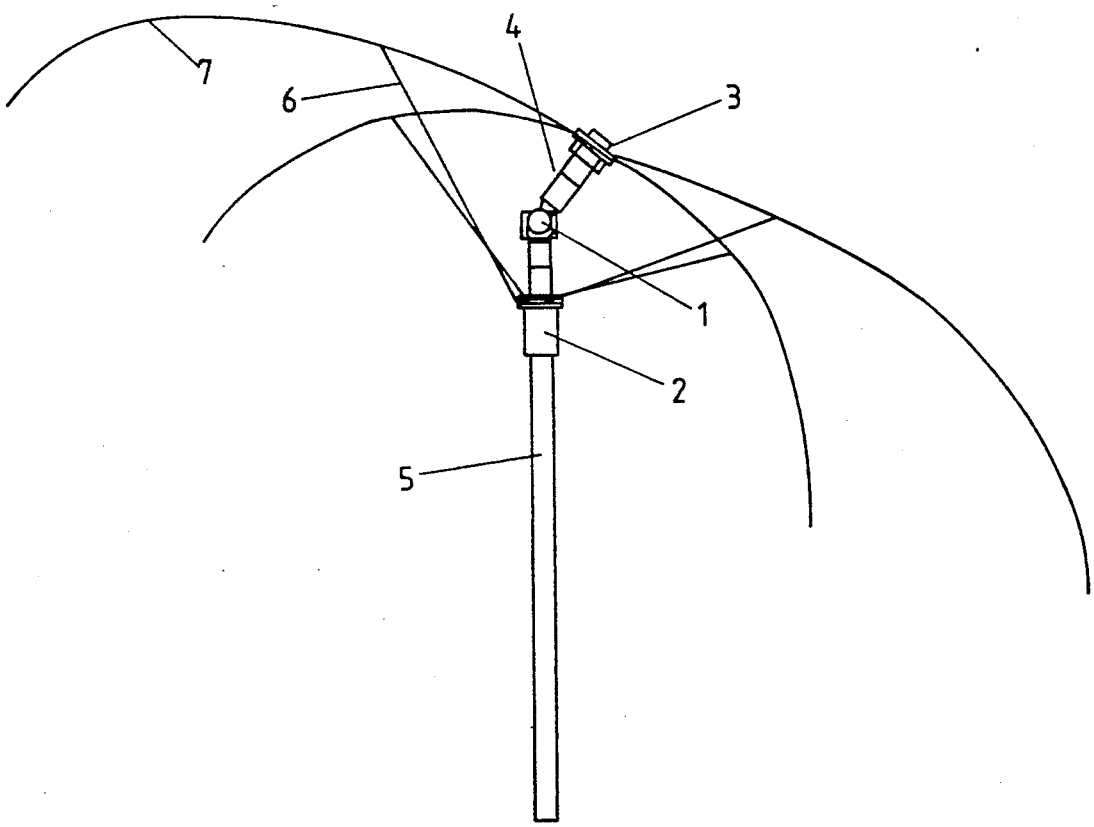
FIG. 6 shows an umbrella frame incorporating the joint of FIG. 4.

FIG. 6 shows a tilting umbrella incorporating a joint 1 as shown in FIG. 4 located between an upper, tiltable, part 4, and a lower part 5 of the shaft, and having ribs 7 and a corresponding number of struts or stretchers 6 extending from a sliding runner 2 on the shaft to the ribs. In the complete umbrella the ribs 7 would of course be spanned by a cover, which is not shown, causing the curvature of the ribs as seen in the drawing. The ribs are pivoted at the top of the shaft on a notch 3.

In FIG. 6, the umbrella frame, which has the joint 1 situated above the runner 2, is shown in its bent configuration. The joint 1 will allow a tilt of about 45° in any one direction. As described above, the flexibility of the ribs and stretchers takes up the deformation caused by the bend in the shaft. In this embodiment the runner does not have to pass over the joint 1 in the shaft, so that there is considerable freedom in designing the joint 1.

In an alternative embodiment, it would be possible to have a further joint located below the runner, in the erected umbrella configuration, provided the joint were so dimensioned that the runner could pass over it (or if the umbrella were not required to be foldable, the joint 20 could be of larger cross-section than the shaft).

Figure 7:
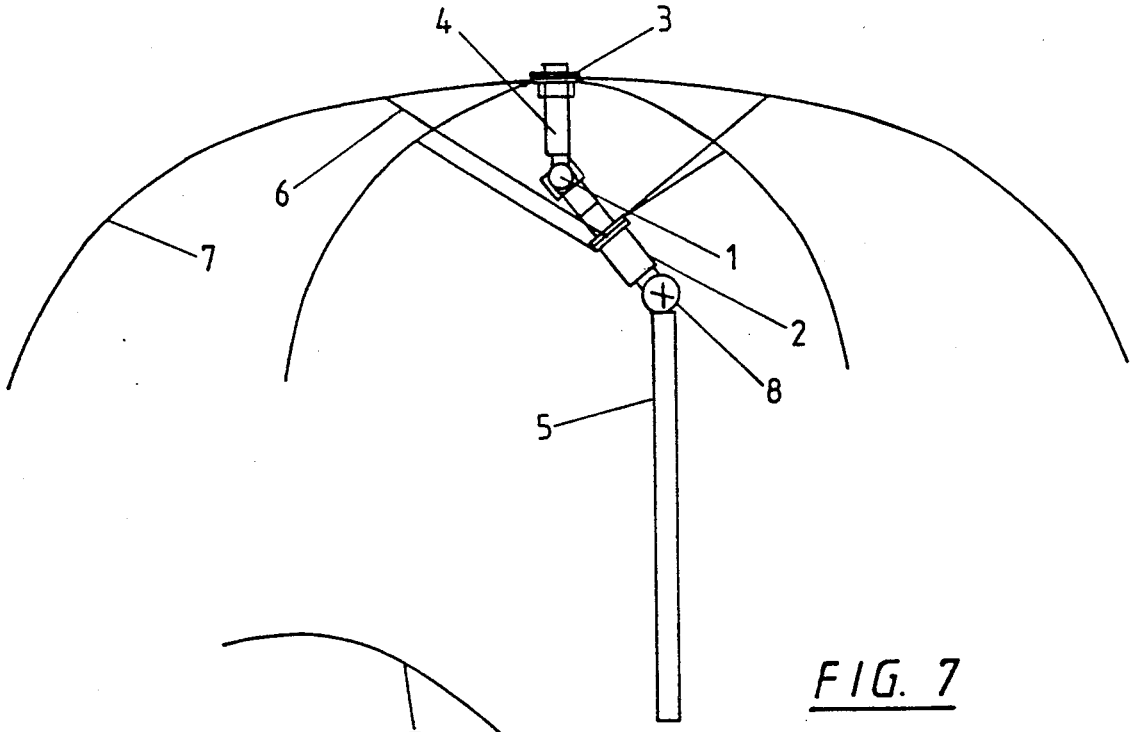
FIG. 7 shows another embodiment with two joints including a joint as shown in FIG. 4.
Figure 8:
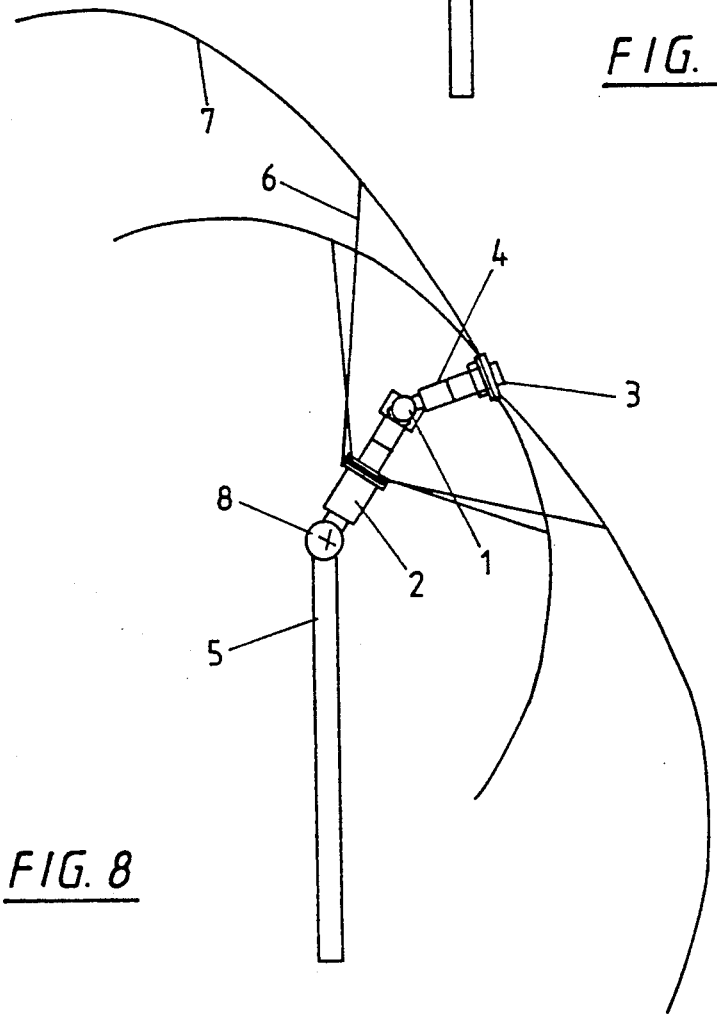
FIG. 8 shows a different arrangement of the FIG. 7 embodiment.

FIG. 8 shows such a further embodiment of the invention wherein, in addition to the joint 1 in an upper position in the shaft, the umbrella also has a standard sleeve and pin kind of joint 8 below the runner 2. The advantage of this arrangement is that, if both joints are capable of bending 45°, a full 90° tilt is possible, bringing the lower edge of the cover right down to the shaft, as shown approximately in FIG. 8. This is desirable for many applications, such as for a fishing umbrella. Alternatively, the two joints 1 and 8 can be bent in reverse directions, resulting in a dog-leg or cantilever arrangement such as shown in FIG. 7. This provides a larger space under the umbrella unobstructed by the shaft.

While the embodiments show a runner 2 allowing the umbrella to be folded, the invention is also applicable to an umbrella or shade of fixed construction, i.e. where the stretchers are fixed to the shaft, with a pivot between that point on the shaft and the notch. In alternative embodiments, in place of the hinge or universal joint described above, the bending facility in the upper part of the shaft can be provided by making it flexible.

The bend or tilt pivot in the upper part 4 of the shaft may be located anywhere between the top of the shaft below the notch 3 and the runner 2, in the extreme case at the top of the runner 2 (or other stretcher location body). However, it is envisaged that the pivot joint 1 will normally be located about mid-way between the notch 3 and runner 2. This provides ease of access and operation, and an effective angle of tilt to the cover, yet a stable tilted condition. If the pivot joint 1 is higher up, nearer to the notch 3, there would be less angle of tilt to the cover, but a more stable tilted assembly; whereas if the pivot joint is lower down, nearer to the runner 2, a greater angle of tilt is possible, but this is somewhat less stable as the centre of gravity would be swung further away from the shaft axis, though not as far as with the known tilt arrangement.

The frame according to the invention could have as many or as few ribs as known frames, such as four, six, eight or ten; or larger numbers of ribs, or an odd number of ribs such as nine. In addition the ribs could be either channel-shaped or solid in cross-section, as known in the art.

It will be appreciated that the present invention provides a new principle of tilting which enables the tilt feature to be employed readily by means of a simple operation, without separation and reassembly of parts and with control of the umbrella at all times. It might even have applications for other umbrellas such as ordinary carried umbrellas, possibly with automatic operation, or for other types of umbrella-construction frames. It might even be possible to use a shaft with a permanent bend or curve in the upper section so that the cover is erected directly into the tilted configuration.

What is claimed is:

1. A frame for an umbrella, having a shaft, ribs pivotally attached to the top of the shaft to extend radially from the top of the shaft, a location body on the shaft, stretchers pivotally attached to the location body and to attachment points on the ribs to extend from the location body to the attachment points on the ribs, and means for locating the location body at a set position on the shaft, opening the ribs to hold open an umbrella cover attached to the ribs, the shaft comprising first and second parts and tilting means connecting the first and second parts, to allow the axis of one part of the shaft to be set in a position inclined with respect to the axis of the other part of the shaft, wherein the tilting means is located at a position between the top of the shaft and the set position of the location body.

2. An umbrella frame according to claim 1, in which the tilting means is a joint.

3. An umbrella frame according to claim 2, in which the joint allows the one part of the shaft to be tilted in different planes with respect to the other part.

4. An umbrella frame according to claim 3, in which the joint is a ball-and-socket joint comprising a ball member and a socket member, the ball member including a neck attached to the first part of the shaft and the socket member being attached to the second part of the shaft, in which the socket is in the form of a cup open in a direction away from the second part and includes means for retaining the ball within the socket, and in which one of the said members has a lug which projects from its spherical surface and the other of said members has a first recess larger enough to accommodate the lug, the lug and first recess being so arranged that when interengaged the two shaft parts are axially aligned, said other of said members having a further, annular recess of a number of further recesses annularly surrounding the first recess and able to accommodate the lug to hole the two shaft parts in relative positions such that the axis of the first shaft part is at a given angle with respect to the axis of the second shaft part while allowing the first shaft part to adopt different angular positions around the axis of the second shaft part, one of the ball member and the socket member being adapted to allow the ball to be rotated within the socket to move the lug from one recess to another to retain the parts in a set position with the lug engaged in a recess.

5. An umbrella frame according to claim 4, in which the socket includes a mouth, and in which the ball and the socket mouth are dimensioned to permit the socket mouth to resiliently receive the ball by a snap-in action for assembly of the joint.

6. An umbrella frame according to claim 4, in which the further recess is annular so as to allow the first part to adopt any angular position around the axis of the second part, when set at the given tilt angle.

7. An umbrella frame according to claim 4, in which the lug is provided on the ball and the recesses are provided in the socket.

8. An umbrella frame according to claim 4, in which the ball is made of nylon and the socket is made of acetal.

9. An umbrella frame according to claim 1, in which the tilting means is located approximately midway between the top of the shaft and the location body.

10. An umbrella frame according to claim 1, further comprising a joint below the location body.

* * * * *